United States Patent [19]

Hamada et al.

[11] Patent Number: 4,565,484

[45] Date of Patent: Jan. 21, 1986

[54] DEVICE FOR ATTACHING FRONT WORKING IMPLEMENT TO VEHICLE BODY

[75] Inventors: Akio Hamada, Toyonaka; Motomu Masuzawa, Osaka; Yoshiaki Matsuda, Sapporo, all of Japan

[73] Assignee: Kubota Ltd., Osaka, Japan

[21] Appl. No.: 499,838

[22] Filed: Jun. 1, 1983

[30] Foreign Application Priority Data

Sep. 21, 1982 [JP] Japan ..... 57-144116[U]

[51] Int. Cl.[4] ..... E02F 3/72

[52] U.S. Cl. ..... 414/686; 414/723

[58] Field of Search ..... 414/686, 723; 292/209, 292/107

[56] References Cited

U.S. PATENT DOCUMENTS

| | | | |
|---|---|---|---|
| 1,088,526 | 2/1914 | Brae | 292/209 |
| 3,324,954 | 6/1967 | Westendorf | 414/686 |
| 3,460,690 | 8/1969 | Seifert | 414/697 |
| 3,610,450 | 10/1971 | Demkiw | 414/498 |
| 3,833,136 | 9/1974 | Spicer et al. | 414/686 |
| 3,939,997 | 2/1976 | Frank | 414/686 |
| 3,949,889 | 4/1976 | Moe | 414/686 |
| 4,051,962 | 10/1977 | Westendorf | 414/686 |
| 4,345,870 | 8/1982 | Anderson et al. | 414/686 |
| 4,383,793 | 5/1983 | Weir | 414/686 |

*Primary Examiner*—Joseph E. Valenza
*Assistant Examiner*—Donald W. Underwood
*Attorney, Agent, or Firm*—Armstrong, Nikaido, Marmelstein & Kubovcik

[57] ABSTRACT

A device for removably attaching a front working implement to a tractor body comprises a bearing portion provided on each side of the front portion of the tractor body and a fitting portion provided on a front portion of each brace of the implement. The bearing portion and the fitting portion are tapered and engageable with each other in a vertical direction. The brace has a lever plate for holding the fitting portion engaged in the bearing portion and a bolt for fastening the lever plate.

6 Claims, 13 Drawing Figures

DEVICE FOR ATTACHING FRONT WORKING IMPLEMENT TO VEHICLE BODY

BACKGROUND OF THE INVENTION

When a front working implement having a bucket, fork or like working portion at the front ends of a pair of opposed booms is to be attached removably to the body of a vehicle, the lower ends of a pair of opposed masts supporting the booms and the front ends of a pair of opposed braces projecting forward from the masts are usually removably connected to bearing portions provided on the tractor body.

For example, U.S. Pat. No. 3,949,889 discloses an arrangement wherein the lower ends of the pair of masts are adapted to be detachably fixed to the tractor body by removable pins, and the braces projecting forward from the masts are each provided at the front end with a hook which is fixedly engageable with a cam pin on the tractor body.

When this conventional arrangement is used for a front working implement the working portion of which is operated for loading, the connections between the implement and the tractor body are insufficient in strength, such that if the implement is advanced and retracted repeatedly, the connections are liable to backlash.

If the front portions of the braces are fastened directly to the mount portions on the tractor body with bolts, a shearing force acts on the bolts during work, possibly breaking the bolt.

Stated more specifically with reference to a case wherein the working implement is a front loader, a tensile force acts on the braces through the booms when the bucket is forced into sand or earth during work, while the braces are subjected to a compressive force when the bucket is retracted with earth placed therein, so that if each brace is merely fastened to the body mount portion laterally with a bolt, the bolt is likely to break.

To prevent the break of the bolt, there is a need to employ a complex structure, which nevertheless renders the working implement difficult to attach to or remove from the tractor body easily. Furthermore, the mount portions will become an obstacle in attaching other working implement to the tractor body to impair the versatile usefulness of the tractor.

SUMMARY OF THE INVENTION

The present invention relates to a device for attaching a front loader, front blade or like front working implement to a vehicle body. More particularly, in an arrangement comprising a pair of opposed booms having a working portion at their front ends, a pair of masts supporting the booms and removably fixed to a vehicle body and braces projecting forward from the masts and removably fixed at their front portions to the vehicle body, the present invention relates to a structure for attaching the front portions of the braces to the vehicle body.

An object of the present invention is to provide a device for attaching a front working implement to the body of a vehicle which device comprises a fitting portion and a bearing portion which are tapered to engage with each other approximately in a vertical direction and provided on the vehicle body and each brace respectively, and means for fastening lever means in a direction to fit the fitting portion into the bearing portion so that the implement can be attached to the vehicle body easily, reliably, firmly and with improved durability.

Another object of the invention is to provide a device of the type described which further comprises a guide member provided above the bearing portion and having a longitudinal guide portion for regulating the position of the fitting portion longitudinally of the vehicle body and guiding the same into the bearing portion by contact with the fitting portion before the fitting portion is fitted in place, the guide member further having a lateral guide portion for regulating the position of the fitting portion laterally of the vehicle body by contact with the brace before the fitting, so that the implement can be attached to the vehicle body easily and accurately.

Another object of the present invention is to provide a device of the type described which is simple in construction and which is designed to permit other working implements to be attached to the vehicle body free of any trouble.

Other features and advantages of the present invention will become apparent from the following description with reference to the accompanying drawings.

DESCRIPTION OF THE PREFERRED EMBODIMENTS

Figure 1:
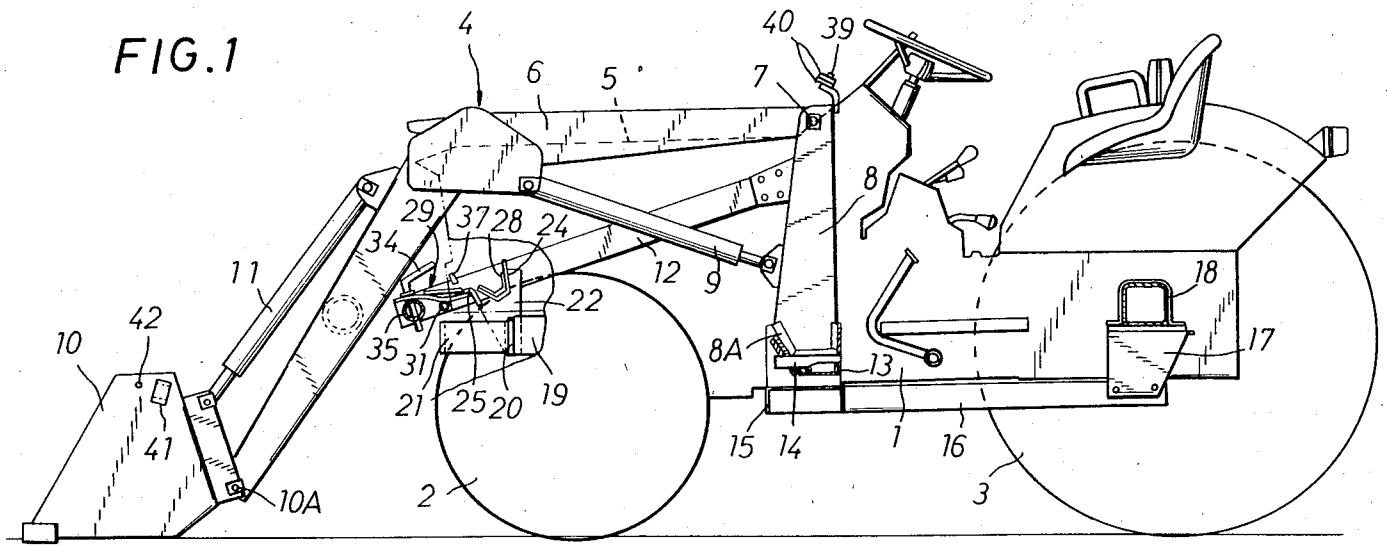
FIG. 1 is a side elevation partly broken away and showing an embodiment of the invention.

With reference to FIG. 1, a tractor body 1 has a pair of front wheels 2 and a pair of rear wheels 3.

A front working implement 4, which is illustrated as a front loader, comprises a pair of opposed booms 6 arranged on opposite sides of a bonnet 5 of the body 1, a pair of masts 8 vertically movably supporting the base ends of the booms 6 by pivots 7, a pair of boom cylinders 9 for raising and lowering the booms 6, a working portion 10 ilustrated as a bucket and connected to the front ends of the booms 6 by a pivot 10A as positioned therebetween, a pair of cylinders 11 for turning the working portion 10, and a pair of braces 12 extending forwardly downward from the masts 8.

The lower end of each mast 8 is in the form of a tapered fitting portion 8A whch is removably fittable into a mast bearing portion 13 from above and is fixed to the portion 13 by a lock member 14 removably inserted therethrough longitudinally of the tractor body 1. The mast bearing portion 13 is provided at each end of a main frame 15 fixed to the bottom of the body 1 and extending laterally between the front wheels 2 and the rear wheels 3. The main frame 15 is connected to a rear axle case 18 by a pair of opposed auxiliary frames 16 extending rearward and by connecting members 17.

Figure 2:
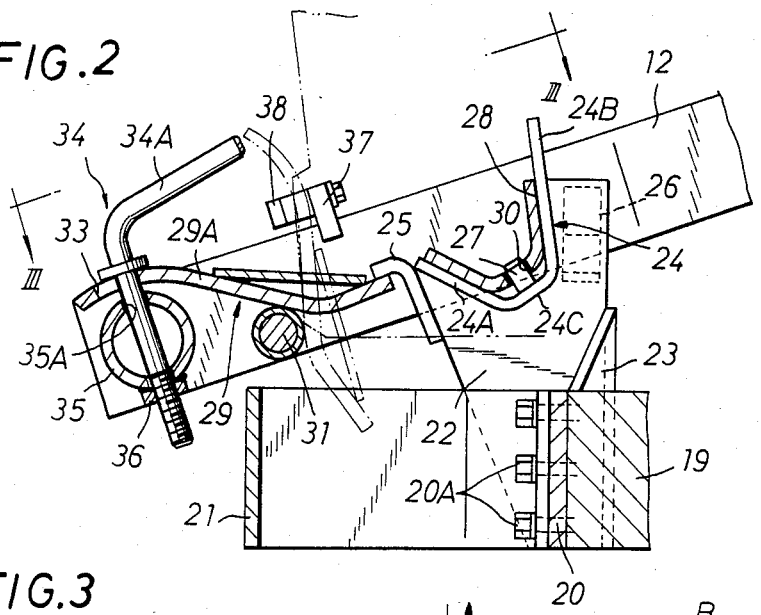
FIG. 2 is a fragmentary sectional view on an enlarged scale.
Figure 3:
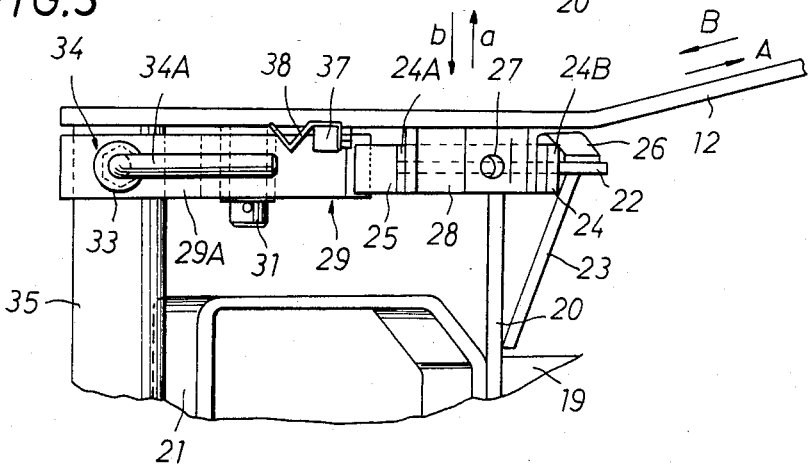
FIG. 3 is a view of the same as it is seen along the line III—III in FIG. 2.
Figure 4:
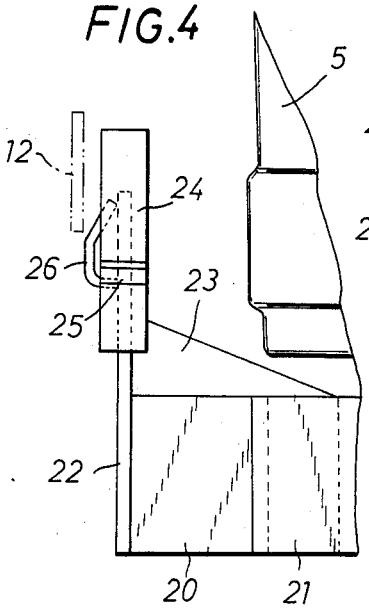
FIG. 4 is a fragmentary front view.

A brace support plate 20 and a bumper 21 are connected by bolts 20A shown in FIG. 2 to a front axle support 19 at a front portion of the tractor body 1. A bracket 22 and a reinforcing plate 23 are fixed to each of opposite ends of the brace support plate 20 as seen in FIGS. 3 and 4.

The bracket 22 is an upwardly projecting plate positioned at each end of the bumper 21 and is provided with a bearing portion 24 thereon fixedly and an engaging portion 25 disposed on the front side of the portion 24 and in the from of an inverted L-shaped plate. To the rear of the bearing portion 24, the bracket 22 further has a guide portion 26 provided on its outer side and projecting laterally outward.

Figure 7:
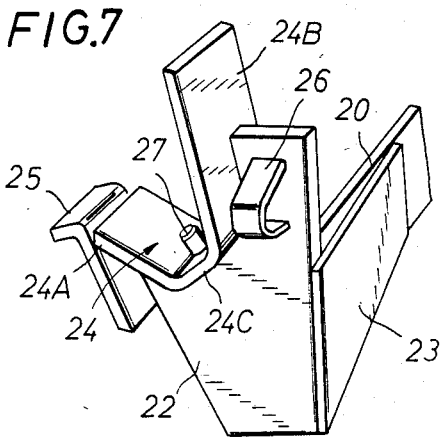
FIG. 7 is a perspective view showing a bearing portion in detail.
Figure 8:
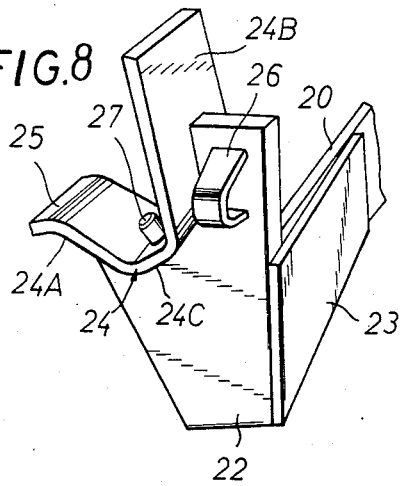
FIG. 8 is a perspective view showing a modified bearing portion.

As shown in FIGS. 2, 7 and 8, the bearing portion 24 is formed by bending a strip of plate approximately to a U shape when seen sidewise, is downwardly tapered and includes a front wall 24A, a rear wall 24B and a bottom wall 24C. The bottom wall 24C has an upwardly projecting positioning pin 27.

The engaging portion 25 may be in the form of a separate inverted L-shaped plate which is welded to the bracket 22 as seen in FIG. 7, or may be integral with the bearing portion 24 as an extension of its front wall 24A as shown in FIG. 8.

The front portions of the braces 12 are spaced apart by a distance which is slightly larger than the distance between the pair of opposite guide portions 26. Each brace 12 has a fitting portion 28 and lever means 29 on the inner side of its front portion. The fitting portion 28 has a positioning hole 30 for the pin 27 to engage in. The fitting portion 28 is tapered and fixed to the brace 12 to fit into the bearing portion 24 from above.

The lever means 29 is engageable with the engaging portion 25 to hold the fitting portion 28 in fitting engagement with the bearing portion 24. With the present embodiment, the lever means 29 comprises a pivot 31 serving as a fulcrum and fixed to the inner side of the brace 12 at a position to the front of the fitting portion 28, and a lever plate 29A rotatably supported on the pivot 31. With the present embodiment, one end of the lever plate 29A is engageable with the engaging portion 25 from below. Fastening means 34 removably inserted through a slot 33 in the the other end, i.e., the front end, of the lever plate 29A fastens the lever plate 29A from above to a connecting rod 35 interconnecting the front ends of the opposed braces 12. As measured from the pivot 31, the lever plate 29A has a larger length to the fastened portion than to the engaging portion 25.

The fastening means 34 includes a fastening bolt 34A having a handle, extending through a hole 35A in the connecting rod 35 and screwed in a nut 36 attached to the lower side of the rod. The bolt 34A is positioned to the front of the front side of the bumper 21 and is thereby made easy to handle.

The lever plate 29A is retainable in an upright position by a stopper 37 attached to the brace 12 and having an elastically deformable elastic member 38.

Each mast 8 has a pin 39 fixed to its upper end. Two bars 40 interconnecting the opposed masts 8 are retained by the pins 39 extending upward therethrough. The connecting bars 40 are usable also as a stand for supporting the working implement 4 as detached from the tractor body 1.

Figure 5:
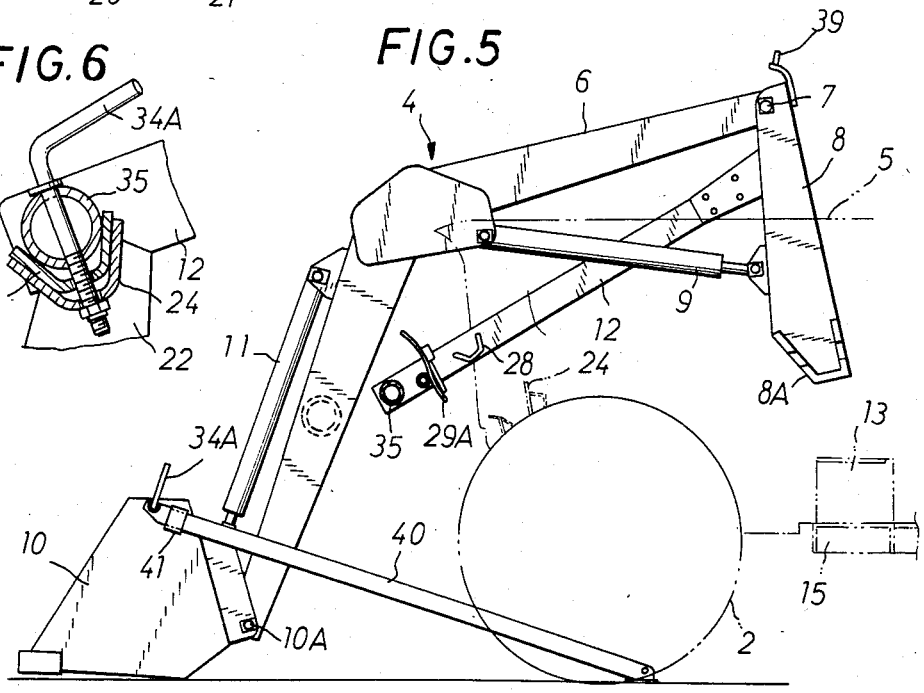
FIG. 5 is a side elevation for illustrating how the embodiment is used.

Stated more specifically with reference to FIG. 5, the connecting bar 40 is removably inserted forwardly through a holder 41 attached to each side of an upper portion of the working portion 10 and can be fixed to the portion 10 utilizing the fastening bolt 34A. At this time, the working implement can be at rest on the ground, with both the bottom of the portion 10 and the rear ends of the connecting bars 40 bearing on the ground. The bolt 34A is screwed into a hole 42 shown in FIG. 1.

Figure 10:
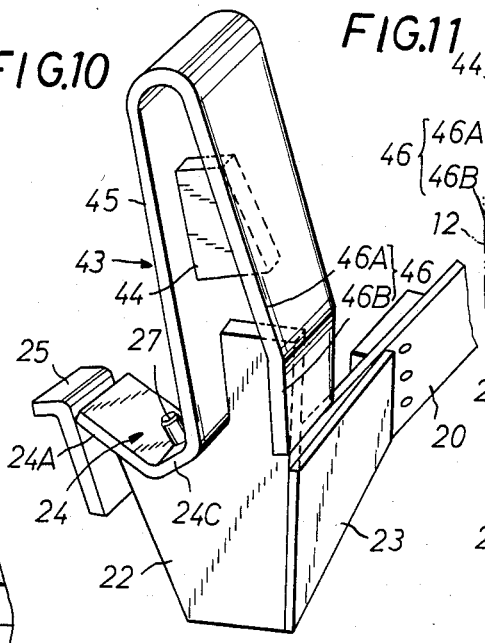
FIG. 10 is a perspective view showing the bearing portion of FIG. 9.
Figure 11:
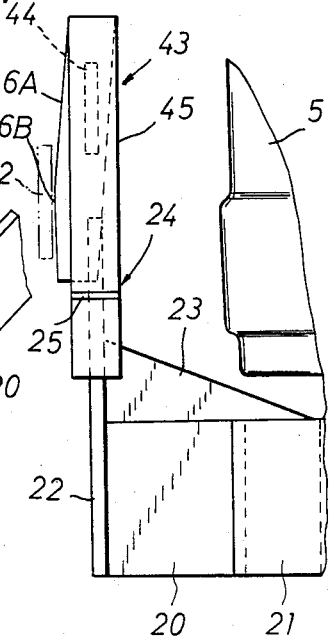
FIG. 11 is a fragmentary front view showing the embodiment of FIG. 9.
Figure 9:
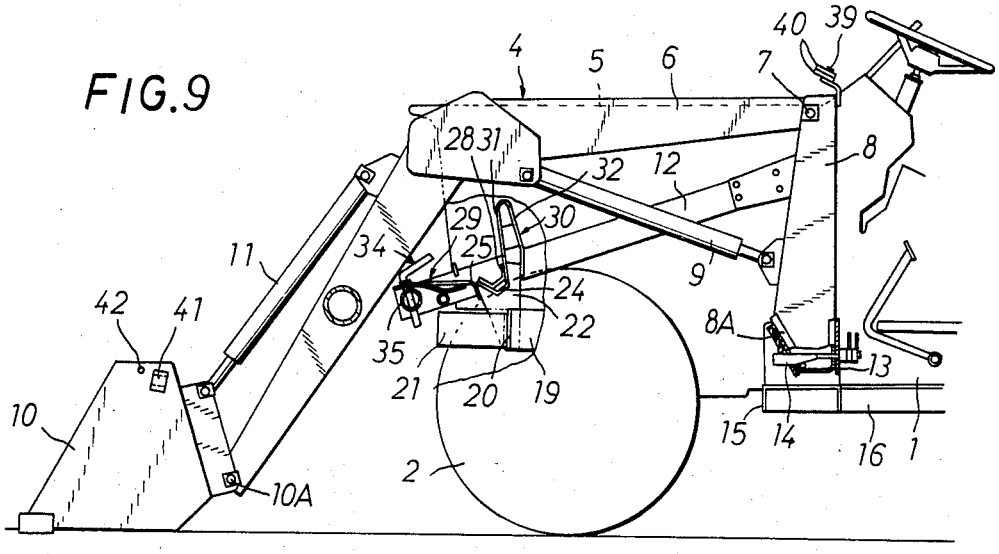
FIG. 9 is a side elevation partly broken away and showing a second embodiment of the invention.

With reference to FIGS. 9 to 11, a guide member 43 extends upward from the rear wall of the bearing portion 24. The upper portion of the guide member 43 is inverted U-shaped and has a reinforcing plate 44 inside. The guide member 43 includes a longitudinal guide portion 45 for regulating the position of the fitting portion 28 longitudinally of the vehicle body 1 and guiding the portion 28 into the bearing portion 24 by contacting the fitting portion 28 before it is fitted in place. The guide portion 45 is forwardly inclined with its upper end positioned forward from its lower end and is flush with the rear wall of the bearing portion 24. The guide portion 45 may be formed along a circular arc centered about the pivot of the working portion 10.

The rear wall of the guide member 43 projects outward sidewise to provide a lateral guide portion 46. Accordingly the portion 46 has a slanting edge 46A extending downwardly outward and continuous with a vertical edge 46B thereunder. Both edges 46A and 46B are adapted to contact the inner side of the brace 12. As the brace 12 is lowered to place the fitting portion 28 into the bearing portion 24, the brace 12 comes into contact with the slanting edge 46A and is thereby outwardly moved sidewise. Thus the position of the fitting portion 28 is laterally corrected relative to the bearing portion 24 so as to fit in as located most optimally.

Although the brace 12, the bearing portion 24, the guide member 43, etc. shown in FIGS. 9 to 11 are those provided on only one side of the vehicle body, those on the other side are similarly constructed. Further the same components as those shown in FIGS. 1 to 5 individually in corresponding relation are referred to each by the same corresponding numeral.

Figure 12:
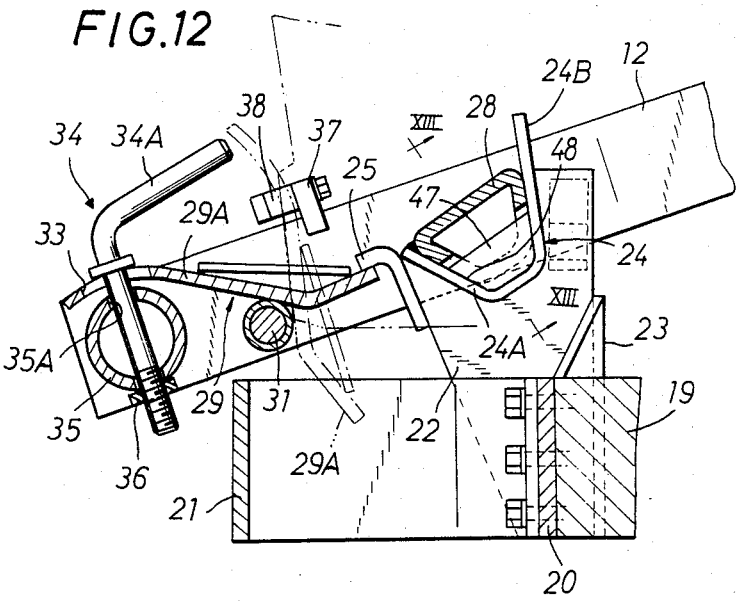
FIG. 12 is an enlarged fragmentary view in section showing a third embodiment.
Figure 13:
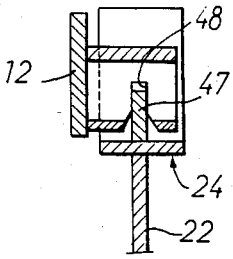
FIG. 13 is a view in section taken along the line XIII—XIII in FIG. 12.

With reference to FIGS. 12 and 13, there is shown positioning means for regulating the position of the bearing portion 24 and the fitting portion 28 relative to each other laterally of the tractor body, i.e., a modification of the positioning means shown in FIG. 2 and including the pin 27 and the hole 30. The positioning means shown in FIGS. 12 and 13 comprises a positioning plate 47 provided on the bottom of the bearing portion 24, interconnecting and reinforcing the front and rear walls 24A, 24B and extending from the bottom to an intermediate portion of the depth of the bearing portion 24. The fitting portion 28 has a slit 48 for the positioning plate 47 to engage in. The position of the fitting portion 28 relative to the bearing portion 24 is regulated by the means laterally of the vehicle body 1.

Throughout FIGS. 2, 12 and 13, like parts are referred to by like reference numerals.

Although the pair of bearing portions 24 is provided on the tractor body 1, and the fitting portions 28 on the braces 12 with the foregoing embodiments, the fitting portions may be provided on the tractor body, and the bearing portions on the braces.

Further although it is most suitable to use a bolt as the fastening means 34, other means, such as a fastening band, can be used insofar as the lever plate 29A can be fastened to the brace 12. The working portion can be a fork, blade, consolidating roller, ram or the like other than the bucket.

The front working implement 4 is attached to the tractor body 1 in the following manner.

FIG. 5 shows the front working implement 4 as detached from the tractor body 1. The mast connecting bars 40 are inserted through the holders 41 on opposite sides of the working portion 10 and fastened to the portion 10 with the bolts 34A, with the rear ends of the bars 40 bearing on the ground as illustrated.

Consequently the working portion 10 and the mast connecting bars 40 serve the function of a stand to position the working implement at rest.

To attach the working implement 4 to the tractor body 1, the tractor body 1 is advanced into the space between the opposed masts 8 from behind to position the bearing portions 24 below the fitting portions of the braces 12, and the body 1 is then halted. When the bearing portions 24 are brought approximately to a position below the fitting portions in the case of the embodiment of FIGS. 9 to 11, the guide members 43 come into contact with the fitting portions 28, so that the operator recognizes visually or by the impact that the implement is positioned properly relative to the tractor body longitudinally thereof.

Thus the tractor body 1 is stopped when the bearing portions 24 have generally been brought into vertically opposed relation to the fitting portions 28. The hydraulic hoses for the cylinders 9, 11 are then connected to the hydraulic hoses on the tractor body 1, and the cylinders 11 are extended by unillustrated control valve means.

Consequently the booms 6 are lowered about the pivot 10A on the working portion 10 to fit the tapered fitting portions 8A of the masts 8 at their lower ends into the bearing portions 13. On the other hand, the fitting portions 28 are fitted into the bearing portions 24 while being guided by the guide portions 26.

In this fitting procedure, each fitting portion 28 is regulated in its position by the front and rear walls 24A, 24B of the bearing portion 24 longitudinally of the tractor body, and the fitting of the positioning pin 27 into the hole 30 regulates the position of the portion 28 laterally, in the case of the embodiment of FIGS. 1 to 5. Further with the embodiment of FIGS. 9 to 11, each fitting portion 28 is lowered while being guided by the longitudinal guide portion 45. At the same time, the brace 12 is lowered while being laterally regulated by the lateral guide portion 46. Thus the fitting portion 28 is properly fitted into the bearing portion 24, with the positioning pin 27 engaged in the hole 30. In the case of FIGS. 12 and 13, the positioning plate 47 fits into the slit 48 to regulate the position laterally.

In any case, each fitting portion can be positioned in place longitudinally and laterally of the body 1. Next, the lock member 14 is inserted through the tapered fitting portion 8A of each mast 8 and the bearing portion 13 to fasten the mast 8 to the bearing portion 13.

The lever plate 29A of the lever means 29 held upright by the stopper 37 and the elastic member 38 is turned about the pivot 31 counterclockwise in FIG. 2 into engagement with the engaging portion 25 from below. Each bolt 34A fastening the mast connecting bar 40 to the working portion 10 is removed, then passed through the slot 33 in the lever plate 29A and screwed into the nut 36 to fasten the lever plate 29A to the connecting rod 35.

This brings the lever plate 29A into engagement with the engaging portion 25 from below, with the pivot 31 serving as a fulcrum, with the result that the tapered bearing portion 24 and the similarly shaped fitting portion 28 are joined together firmly and reliably. When the bearing portion 24 is provided on the brace 12, with the fitting portion 28 on the body 1, the lever plate 29A is brought into engagement with the engaging portion 25 from above, so that the lever plate 29A is positioned beneath the connecting rod 35 and fastened thereto from below by the bolt 34.

In either case, the tapered fitting portion 28 and bearing portion 24 thus fitting together are restricted in position longitudinally of the tractor body and are further restricted laterally thereof by the positioning pin 27 or plate 47.

Since the fastening bolt 34 is away from the bearing portion 24 and the fitting portion 28, there is no likelihood that a shearing force will act on the fastening bolt 34 and cause damage thereto.

Figure 6:
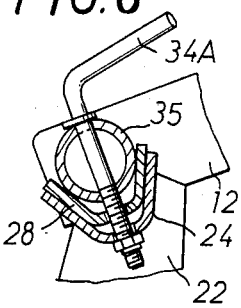
FIG. 6 is a sectional view showing a comparative example.

FIG. 6 shows a comparative example, in which a connecting rod 35 has a fitting portion 28, a bearing portion 24 has a nut 36 secured thereto, and a fastening bolt 34 is inserted through the connecting rod 35, the fitting portion 28 and the bearing portion 24 and screwed into the nut 36. This arrangement involves the problem that a lateral shearing force acting on the fastening bolt 34 is likely to break the bolt or cause damage to the screw portion, whereas according to the invention wherein the lever plate 29A is fastened to the connecting rod 28 at a location away from the bearing portion 24 and the fitting portion 28, these portions 24 and 28 can be fitted together very firmly without influencing the fastening bolt 34. The problem encountered with the arrangement of FIG. 6 can be completely overcome further because of the presence of the positioning pin 27 or plate 47. Further because the positioning pin 27 or plate 47 permits no lateral displacement of the fitting portion 28, the bearing portion 24 can be of a reduced lateral width and can be positioned close to the bonnet 5. Stated in detail with reference to a front loading operation, the brace 12 is subjected to a tensile force and a compressive force as indicated by arrows A and B in FIG. 3. These forces have components of arrows a and b. However, the front and rear walls 24A and 24B of the bearing portion 24 act against the forces A and B, while the positioning pin 27 or plate 47 resists the components a and b to effectively prevent the displacement of the fitting portion 28.

Briefly, the device of the present invention comprises a fitting portion and a bearing portion which are tapered to engage with each other approximately in a vertical direction and one of which is provided on each side of the body of a vehicle, the other portion being provided on each brace, such that the two portions are fitted and fastened together. Accordingly the front portion of the brace can be attached to and removed from the vehicle body with extreme ease. The device further comprises an engaging portion provided on the vehicle body and positioned close to these portions, lever means mounted on the brace and engageable with the engaging portion to hold the fitting portion and the bearing portion in fitting engagement with each other, and means for fastening the lever means in a direction to fit the two portions together. The fitting portion and the bearing portion can therefore be connected together reliably and firmly. The fastening means is less loaded than when fastening the two portions directly and is accordingly free of break or damage and durable.

What is claimed is:

1. In an arrangement including a pair of opposed booms having a working portion at their front ends, a pair of masts supporting the booms and removably fixed to a vehicle body and a brace projecting forward from each of the masts, a device for attaching a front working implement to the vehicle body comprising a fitting portion and a bearing portion which are tapered to engage with each other approximately in a vertical direction and one of whch is attached to the vehicle body, the other portion being attached to a longitudinally intermediate portion of the brace toward its front end, an engaging portion provided adjacent the front side of the bearing portion and the fitting portion, lever means, the rearward end of having a lever plate with forward and rearward ends, said lever means the lines plate mounted on the front portion of the brace engageable with the engaging portion to hold the fitting portion and the bearing portion in fitting engagement with each other, the lever plate pivotally movably supported intermediate its ends by a pivot on the brace, the pivot being disposed away from and to the front of the engaging portion, the lever plate extending forward from the pivot, and means for fastening the lever means in a direction to fit the fitting portion into the bearing portion, the fastening means being provided at the forward end of the lever plate so that the lever plate can be fastened to the brace at a position forwardly away from the location where the fitting portion fits to the bearing portion.

2. A device as defined in claim 1 wherein the bearing portion has a front wall and a rear wall, and the fitting portion is shaped to have a wall adapted for contact with the front and rear walls of the bearing portion, one of the bearing portion and the fitting portion being provided with laterally regulating means, the other portion being provided with means for receiving the regulating means.

3. A device as defined in claim 1 wherein the lever means is a lever plate rotatably supported on a pivot projecting laterally from the brace, and the lever plate is engageable from below with the engaging portion fixedly provided on the vehicle body, the fastening means being a fastening bolt threadedly mounted in the front end of the brace from above for fastening the lever plate in the engaging direction.

4. A device as defined in claim 1 wherein the bearing portion is mounted on each of opposite sides of a support plate fastened to a front portion of the vehicle body along with a bumper, and the fitting portion is attached to the inner side of the brace, the means for fastening the lever means being positioned to the front of the front end of the bumper.

5. A device as defined in claim 3 wherein the brace is provided with a stopper and an elastic member for retaining the lever plate in an upright position.

6. In an arrangement including a pair of opposed booms having a working portion at their front ends, a pair of masts supporting the booms and removably fixed to a vehicle body and a brace projecting forward from each of the masts, a device for attaching a front working implement to the vehicle body comprising a fitting portion and a bearing portion which are tapered to engage with each other approximately in a vertical direction and one of which is provided on the front portion of the brace, the other portion being provided on the vehicle body, an engaging portion provided on the vehicle body, lever means mounted on the front portion of the brace at a spaced location from the fitting portion and the engaging portion and having one end engageable with the engaging portion and it other end movable to hold the fitting portion and the bearing portion in fitting engagement with each other, means for fastening the other end of the lever means in a direction to force the fitting portion into the bearing portion, said bearing portion being provided at each side of the vehicle body, and the fitting portion is provided on the front portion of the brace to fit into the bearing portion, a guide member being provided above the bearing portion and having a longitudinal guide portion for regulating the position of the fitting portion longitudinally of the vehicle body and guiding the fitting portion into the bearing portion by coming into contact with the fitting portion before it is fitted into place, the guide member further having a lateral guide portion for regulating position of the fitting portion laterally of the vehicle body by coming into contact with the brace before the fitting.

* * * * *

UNITED STATES PATENT AND TRADEMARK OFFICE

CERTIFICATE OF CORRECTION

PATENT NO. : 4,565,484

DATED : January 21, 1986

INVENTOR(S) : Akio HAMADA et al

It is certified that error appears in the above-identified patent and that said Letters Patent is hereby corrected as shown below:

Claim 1, line 14, delete ", the rearward end of";
lines 15 and 16, delete "the lines plate";
line 16, after "brace" insert --, the rearward end of the lever plate--.

Signed and Sealed this

*Second* Day of *September 1986*

[SEAL]

*Attest:*

DONALD J. QUIGG

*Attesting Officer*

*Commissioner of Patents and Trademarks*